United States Patent [19]

Rohner et al.

[11] 4,419,858

[45] Dec. 13, 1983

[54] THREAD SPLICING DEVICE

[75] Inventors: Joachim Rohner; Heinz Zumfeld; Reinhard Mauries, all of Monchen-Gladbach; Hans-Jürgen Preuhs, Willich, all of Fed. Rep. of Germany

[73] Assignee: W. Schlafhorst & Co., Monchen-Gladbach, Fed. Rep. of Germany

[21] Appl. No.: 315,411

[22] Filed: Oct. 27, 1981

[30] Foreign Application Priority Data

Oct. 29, 1980 [DE] Fed. Rep. of Germany ..... 3040662

[51] Int. Cl.[3] ..... B65H 69/06; D02J 1/08

[52] U.S. Cl. ..... 57/22

[58] Field of Search ..... 57/22, 27, 333, 350; 28/271-276

[56] References Cited

U.S. PATENT DOCUMENTS

| | | | |
|---|---|---|---|
| 3,306,020 | 2/1967 | Rosenstein | 57/22 |
| 3,345,809 | 10/1967 | Gemeinhardt et al. | 57/22 |
| 3,407,583 | 10/1968 | Irwin et al. | 57/22 |
| 3,477,217 | 11/1969 | Bell et al. | 57/22 |
| 3,648,336 | 3/1972 | Bevington, Jr. | 57/22 X |
| 4,002,012 | 1/1977 | Norris et al. | 57/22 |

*Primary Examiner*—John Petrakes

*Attorney, Agent, or Firm*—Herbert L. Lerner; Laurence A. Greenberg

[57] ABSTRACT

Thread splicing device, including a stationary base body having a first compressed-air canal formed therein, a splicing head being interchangeably connected to the base body, the splicing head having a second compressed-air canal formed therein being in communication with the first compressed-air canal formed in the base body and the splicing head having a splicing chamber formed therein being in communication with the second compressed-air canal formed in the splicing head, the splicing chamber including a selectively coverable longitudinal slot for inserting and joining threads, the slot having a flat slot bottom and a substantially prismoidal cross section being modified in accordance with specifications of the threads to be spliced.

30 Claims, 21 Drawing Figures

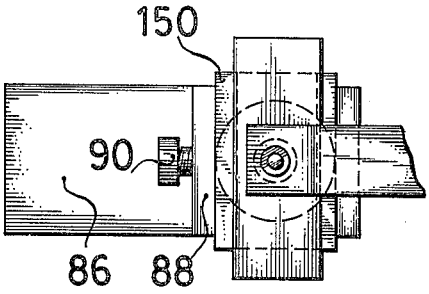
FIG. 2
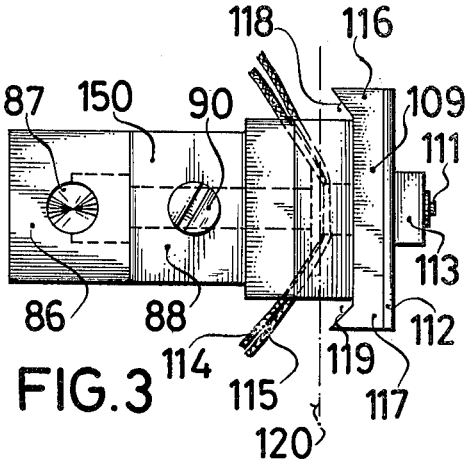
FIG. 3
FIG. 1
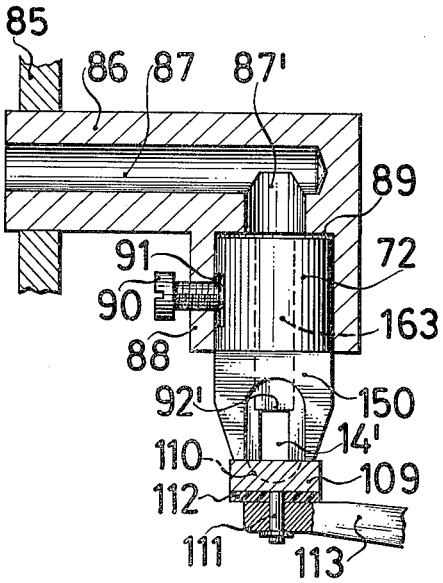

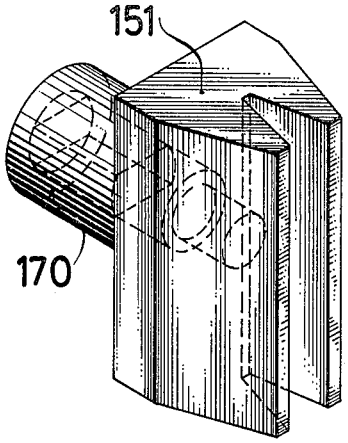
FIG. 4
FIG.6
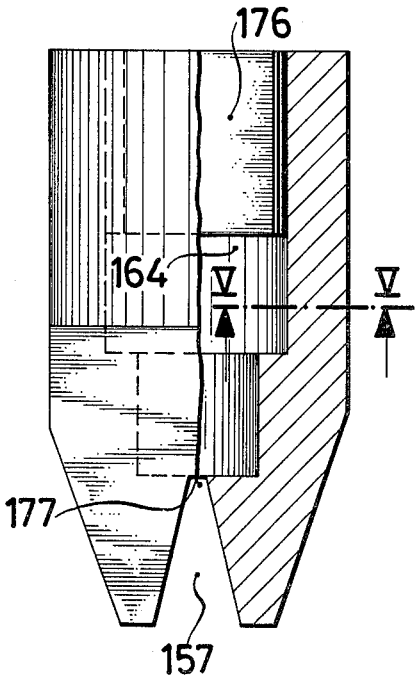
FIG.5
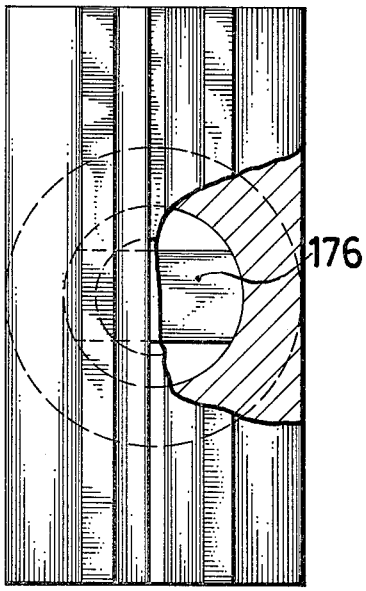

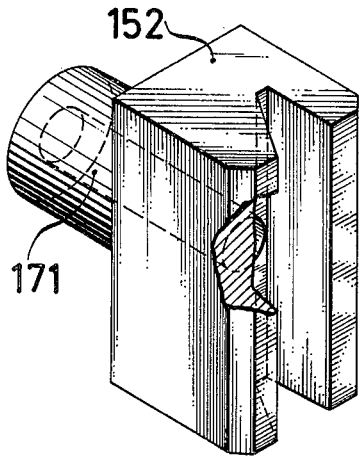
FIG. 7
FIG. 9
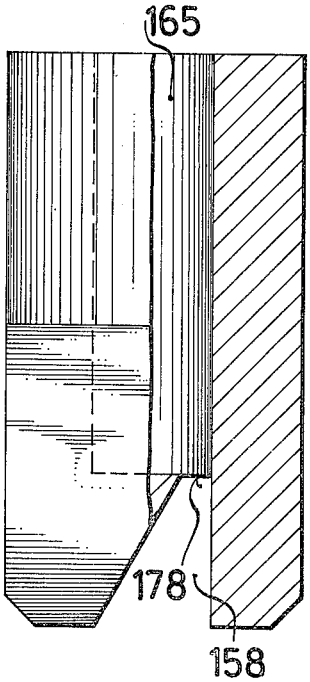
FIG. 8
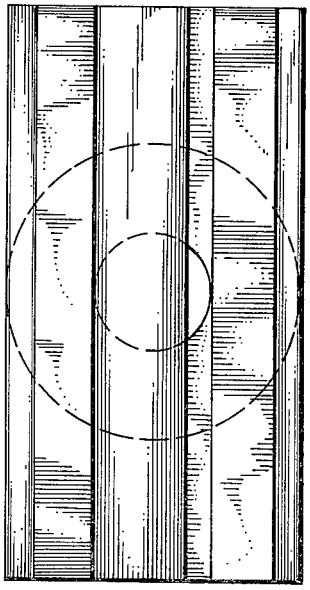

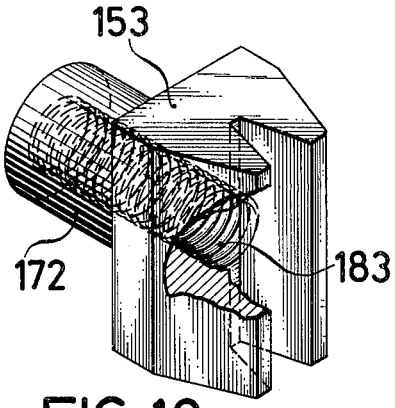
FIG. 10
FIG. 12
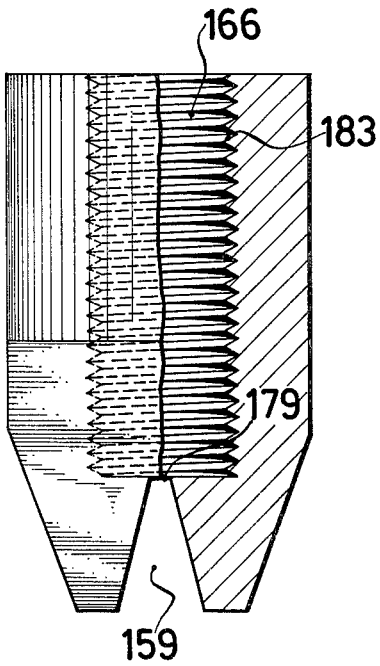
FIG. 11
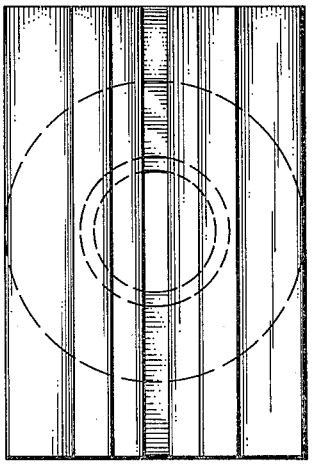

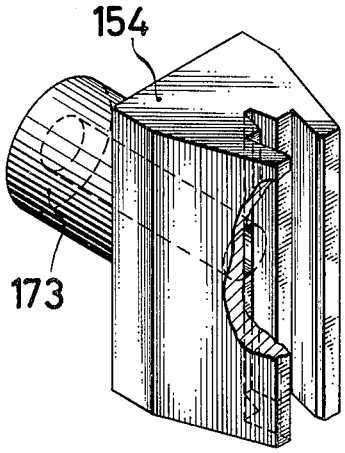
FIG. 13
FIG. 15
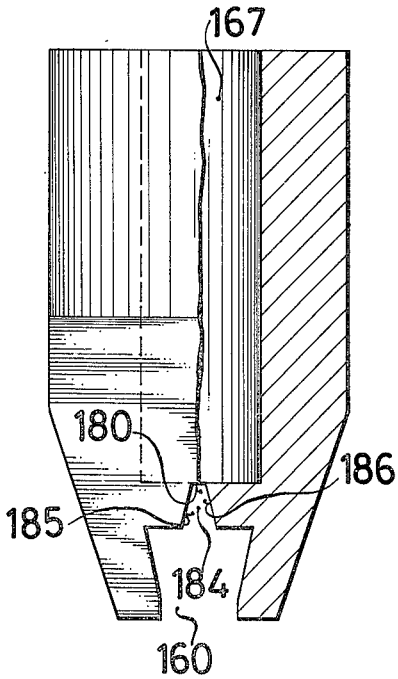
FIG. 14
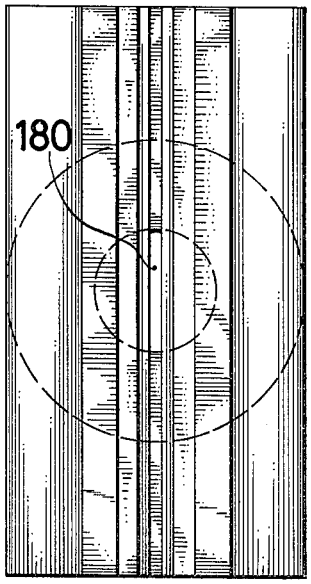

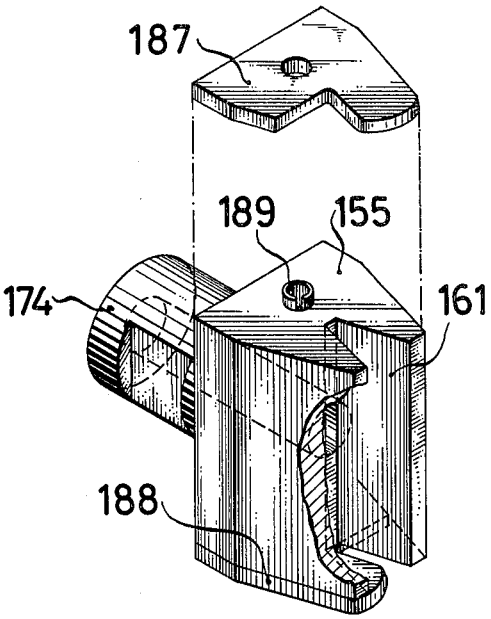
FIG. 16
FIG. 18
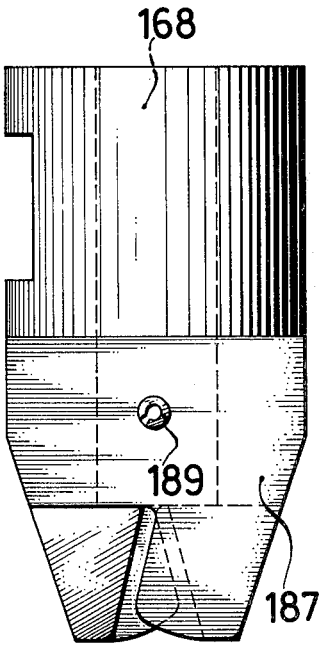
FIG. 17
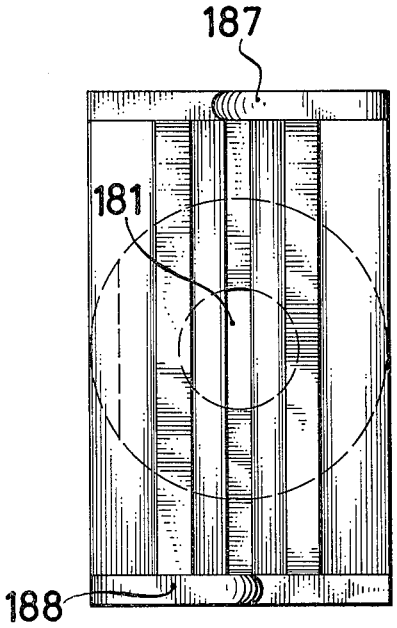

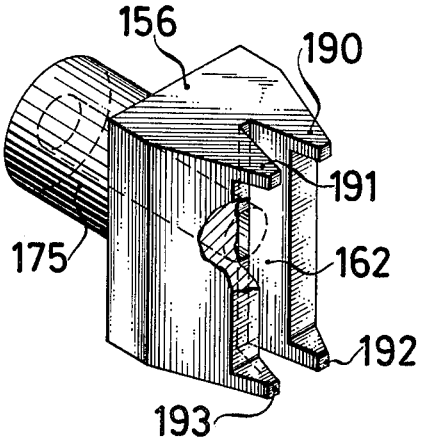
FIG. 19
FIG. 21
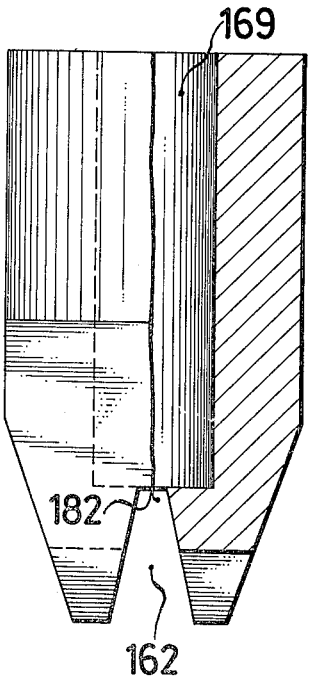
FIG. 20
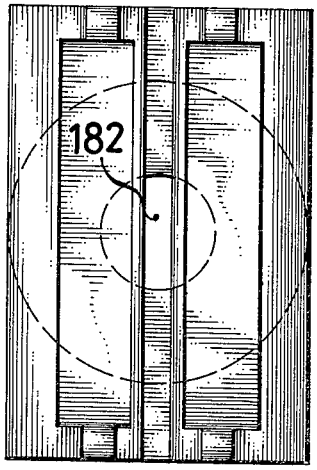

THREAD SPLICING DEVICE

The invention relates to a thread splicing device with a splicing head which has a splicing chamber with a longitudinal slot formed therein, that can be optionally covered for inserting and joining the threads, a compressed-air canal opening into the splicing chamber, and an optional cover for temporarily covering the longitudinal slot.

Since the usability of the known thread splicing devices is limited and one and the same splicing head cannot be used very well for different threads and yarns, such as long staple yarns, short staple yarns, or for different yarn thicknesses and different yarn twists, it has already been proposed in co-pending U.S. Patent Application Ser. No. 225,636, filed Jan. 16, 1981, and now abandoned, to provide a stationary base body with a compressed-air-carrying canal, and to connect the splicing head to the base body so that it can be readily interchanged. It was left open in that publication as to what the details of the nature and the construction of the splicing head must be to produce an effective splicing of different yarns, twines and threads.

It is accordingly an object of the invention to provide a thread splicing device which overcomes the hereinafore-mentioned disadvantages of the heretofore-known devices of this general type, and in which the splicing heads not only are readily interchangeable, but in which each individual splicing head is already adjusted for the effective splicing of certain yarns, twines and threads.

The basic idea of the invention is to see to it that the shape, cross section, arrangement, cover and ratio of the cross section of the longitudinal slot to the length of the longitudinal slot, as well as the shape, cross section, orientation, mouth and ratio of the cross section of the longitudinal slot to the cross section of the mouth of the compressed-air canal opening into the longitudinal slot are optimally adapted to the diameter, cross section, volume, number, twist, type of fiber, fiber length, fiber structure, surface structure of the fibers, staple length, surface structure of the thread, thread roughness and/or moisture content, degree of electrostatic charging, content of sizing, and content of foreign material of the threads to be joined together.

With the foregoing and other objects in view there is provided, in accordance with the invention, a thread splicing device, comprising a stationary base body having a first compressed-air-carrying canal formed therein, a splicing head being readily interchangeably connected to the base body, the splicing head having a second compressed-air canal formed therein being in communication with the first compressed-air canal formed in the base body and the splicing head having a splicing chamber formed therein being in communication with the second compressed-air canal formed in the splicing head, the splicing chamber including a selectively coverable longitudinal slot for inserting and joining threads, the slot having a flat slot bottom and a substantially prismoidal or prismatic cross section being modified in accordance with specifications of the threads to be spliced.

In accordance with another feature of the invention, there is provided a cover for temporarily covering the longitudinal slot during splicing.

In accordance with a further feature of the invention, the longitudinal slot has a substantially rectangular or square cross section.

In accordance with an added feature of the invention, the splicing head has side walls of the longitudinal slot formed thereon, and the longer sides of the rectangular cross section of the longitudinal slot are deposited at the side walls.

In accordance with an additional feature of the invention, the longitudinal slot has a substantially trapezoidal cross section, the longer or shorter base of which is disposed at the slot bottom.

Thus, an arrangement is obtained in which either the shorter base or the longer base of the trapezoid lies in the bottom of the base. In the first case, the longitudinal slot has divergent lateral surfaces; in the second case, it has converging lateral boundaries. Parallel or divergent lateral boundaries are particularly well suited for splicing very coarse yarns, such as for splicing rug yarns or wool yarns, for splicing yarns with a large content of foreign bodies, and for stronger electrostatic charging of the thread. Convergent lateral boundaries are especially suitable for splicing cotton threads and heavily sized threads.

In accordance with again another feature of the invention, the splicing head has a substantially V or U-shaped groove being formed therein in the slot bottom and extended along the longitudinal slot. This groove has two purposes. It can be made, on one hand, wide enough to initially receive the threads to be spliced. It is then assured that the threads will lie close together prior to the splicing process itself. However, the groove may also serve the purpose of better distributing the splicing air and of accelerating the threads to be spliced toward the cover.

To fulfill this purpose, in accordance with again a further feature of the invention, the compressed air from the second compressed-air canal discharges in the groove. In other words, the compressed-air outlet lies in the groove. Effective, optimal splicing, i.e., good mixing of the fibers, is achieved if, in accordance with again an added feature of the invention, the splicing head has lateral boundaries of the grooves formed thereon being disposed at an angle of substantially 30° to each other. The compressed air emerging from the bottom of the groove has an optimum fan effect with this construction of the lateral boundaries, and the threads to be inserted are brought into good contact with each other by the inclined position of the lateral boundaries.

An enlarged cross section of the end section of the longitudinal slot can be obtained by rounding the edges of the longitudinal slot. Since rounding the edges also facilitates the insertion of the threads and prevents damage, in accordance with again an added feature of the invention, the splicing head has rounded and smoothed edges of the longitudinal slot formed thereon. All edges of the longitudinal slot are meant to be included in this context.

In accordance with again an additional feature of the invention, the splicing head has ends of the longitudinal slot formed thereon, and including means disposed at the ends for selectively guiding thread and/or air.

In accordance with yet another feature of the invention, the guiding means are in the form of metal plates partially closing off the ends of the slot.

In accordance with yet a further feature of the invention, the guiding means are in the form of thread guides extended beyond or out of the longitudinal slot.

The advantages of such guiding means are obvious. With the cover open, the threads can be inserted into the longitudinal slot quickly and securely. During the splicing, the air can be kept in part in the splicing chamber, or deflected in an advantageous direction. All of these advantages together make for effective splicing.

Effective, optimal spliced joints are obtained if, in accordance with yet an added feature of the invention, the ratio of the length of the longitudinal slot to the cross section of the longitudinal slot is between 0.5 and 1.0. This is true, for instance, in splicing coarse yarns. For splicing medium-fine yarns it is of advantage if, in accordance with yet an additional feature of the invention, the ratio of the length of the longitudinal slot to the cross section of the longitudinal slot is between 1.0 and 1.5. For very fine or coarsely-twisted yarn, it is advantageous if in accordance with still a further feature of the invention, the ratio of the length of the longitudinal slot to the cross section of the longitudinal slot is between 2.5 and 4.0, i.e., in any event, a 1 $mm^2$ slot cross section is available for every 2.5 to 4.0 mm slot length. The preference for these ranges does not, however, preclude that under special conditions, dimensional ratios outside or between these ranges may also be advantageous.

In accordance with another feature of the invention, the splicing head has an air discharge nozzle formed therein at an end of the second compressed-air canal in vicinity of the splicing chamber, the air discharge nozzle having at least one of a smaller open cross section and/or a different cross-sectional shape than said second compressed-air canal. Thus, a discontinuity is present in any case at the transition to the air discharge nozzle, which advantageously triggers air turbulence. If the free cross section of the air discharge nozzle is smaller than the inner cross section of the compressed-air canal, the pressure drop in the compressed-air canal is not noticed as much during the splicing.

Normally, the longitudinal slot of the splicing head is symmetrically formed. Under this condition, in accordance with a further feature of the invention, at least one of the second compressed-air canal and/or the air discharge nozzle are disposed at the intersection of two planes of symmetry of the longitudinal slot. Both features have advantages. A compressed-air canal disposed at the crossing of the symmetry planes has advantages concerning the external shape and the interchangeability of the splicing head. An air discharge nozzle located at the crossing of the symmetry planes distributes the air uniformly and allows the uniformly distributed emergence of air to both ends of the longitudinal slot.

The ratio of the cross section of the longitudinal slot to the total cross section of the air discharge nozzle has a great influence on the effectiveness and the optimal success of the splicing and on the quality of the spliced joint. To this end, in accordance with an added feature of the invention, the ratio of the cross section of the longitudinal slot to the cross section of the air discharge nozzle is between 1.4 and 2.5 or 3.5 and 4.0. The first mentioned range is advantageous for bulky threads, wool threads, rug yarns and the like. The second range from 3.5 to 4.0 is suitable particularly for simple yarns and mixed-wool yarns, but also for splicing cotton yarns.

The preference for these ranges, however, does not preclude that under special conditions cross-sectional ratios outside these ranges could also be advantageous.

In accordance with an additional feature of the invention, the air discharge nozzle is in the form of a slit being disposed in a plane of symmetry passing lengthwise through the longitudinal slot. The advantage obtained thereby is that the air jet can penetrate centrally into the threads to be spliced over a greater length, but is still capable of forming lateral air eddies. A slot-like air discharge nozzle results in longer and therefore more durable splices and is suitable for threads with a high moisture content, high sizing content and a higher content of foreign substances.

It has already been mentioned above that a turbulent flow has advantages in splicing. Therefore, in accordance with again another feature of the invention, there is provided a turbulence generator at least partly disposed in the second compressed-air canal. In accordance with again a further feature of the invention, the turbulence generator is in the form of an obstacle extended crosswise through the second compressed-air canal. Such an obstacle is easy to make and install. This can be an inserted pin or a canal insert.

In accordance with again an added feature of the invention, the splicing head has a wall of the second compressed-air canal formed thereon, and the turbulence generator is in the form of macroscopic wall irregularities on the wall. Wall irregularities smaller than macroscopic, according to experience, do not lead to sufficient turbulence.

In accordance with again an additional feature of the invention, the wall irregularities are in the form of a screw thread disposed in the wall. Since the compressed-air canal usually is of circular cross section, such a screw thread is easy to make. The effectiveness of the wall irregularities can easily be varied by the choice of the pitch and the depth of the thread.

In accordance with yet another feature of the invention, the splicing head includes a plug-in base being extended into the base body, the second compressed-air canal being at least partly formed in the plug-in base. This has various advantages. Firstly, the sealing between the base body and the splicing head can be accomplished sufficiently without separate sealing means because of the labyrinth effect, and secondly the splicing head is given a firm hold in the base body. Thirdly, the plug-in base simultaneously serves as a wall of the compressed-air canal.

To prevent the splicing head from turning, and in order to connect the splicing head to the base body quickly and securely, while retaining the easy replaceability, in accordance with yet a further feature of the invention, the plug-in base has a cylindrical outer surface having a flat formed thereon, and the base body includes a holding element directed toward the flat. Such a holding element can be a fastening screw, for instance, the end of which is aimed at the flat of the plug-in base. Other holding elements can also be used, such as switching pins with spring loading, pawls operable by hand with spring loading, or the like.

In the interest of effective splicing the interaction between the cover and the splicing head must also be considered.

In order to prevent a poorly constructed cover from canceling the good air guidance and the optimum splicing effect obtained through the use of the invention, in accordance with yet an added feature of the invention, the cover has ends and is extended beyond the splicing head along the direction of the length of the longitudinal slot, and including thread hold-down devices at the ends of the cover. The emerging air flows at the same time against these thread hold-down devices, which thus influence the splicing process directly. In addition, they serve for holding the threads or for limiting the thread motion during the splicing process.

In accordance with a concomitant feature of the invention, in order for the air to be able to flow out of the splicing head readily and at the same time to damp the thread movement, the thread hold-down devices have air guiding surfaces formed thereon being directed at an angle against the travel direction of the threads to be spliced.

All in all the invention provides an expert with the knowledge necessary for constructing the splicing head in such a way that it is adapted overall to the diameter, cross section, volume, number, twist, type of fiber, fiber length, fiber structure, surface structure of the fibers, surface roughness of the fibers, staple length, surface structure of the thread, thread roughness and/or moisture content, degree of electrostatic charge, sizing content, and content of foreign bodies of the threads to be joined together, in an optimum manner.

Other features which are considered as characteristic for the invention are set forth in the appended claims.

Although the invention is illustrated and described herein as embodied in a thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of a first embodiment of the thread splicing device of the invention;

FIGS. 2 and 3 are bottom plan and side elevational views, respectively, of FIG. 1;

FIG. 4 is a perspective view of a splicing head according to a second embodiment of the invention;

FIG. 5 is a front elevational view of FIG. 4, partly broken away to show a view taken along the line A—A in FIG. 6, in the direction of the arrows;

FIG. 6 is a top plan view of FIG. 4, the part thereof to the right of the center line being broken away; and FIGS. 7–21 are perspective, front elevational, and top plan views, respectively, of third through seventh embodiments of the invention, similar to FIGS. 4–6.

Referring now to the figures of the drawing, and first particularly to FIGS. 1–3 thereof, there is seen a frame 85 which carries a base body 86 of the thread splicing device, which is shown only with its essential details. The base body 86 has an angled-off compressed air-carrying canal 87, 87'. The base body 86 furthermore has a holding device for a splicing head 150. The holding device includes an eye 88 having a receiving bore hole 89 formed therein and a holding element in the form of a fastening screw 90. The counterpart of this holding device is provided in the splicing head 150 in the form of a cylindrical plug-in base 72, which has a flat 91 formed thereon against which the holding element 90 is directed.

The splicing head 150 has a splicing chamber formed therein. A compressed-air canal 163 leads through the plug-in base 72 to the vicinity of a longitudinal slot 14' having a rectangular cross section, where it ends at an air discharge nozzle 92'. The air discharge nozzle 92' has a smaller free or open cross section than the cylindrical compressed-air canal 163. The air discharge nozzle 92' also has a different cross-sectional shape; it is slit-shaped.

The splicing head 150 can be covered by a pivotable cover 109. The cover 109 has a smooth surface facing the longitudinal slot 14'. However, it is also optional to provide the cover 109 with a longitudinal slot 110 formed therein which fits the cross-sectional shape of the longitudinal slot 14' of the splicing head 150 better. By means of a holding device 111, the cover 109 is fastened to a cover holder 113 with the interposition of a resilient plastic plate 112.

It is seen particularly from FIG. 3 that the cover 109, which temporarily covers the longitudinal slot during the splicing of the threads 114, 115, extends beyond the splicing head 150 in the direction of the longitudinal slot and has thread hold-down devices 116, 117 at its ends. The thread hold-down device 116 has an air-guiding surface 118 formed thereon and the thread hold-down device 117 similarly has an air-guiding surface 119. The air-guiding surfaces are directed obliquely against the travel direction 120 of the threads 114, 115 to be spliced, as indicated by a dot-dash line.

In the second embodiment example of the invention shown in FIGS. 4, 5 and 6, there is seen a splicing head 151 with a plug-in base 170, the dimensions of which agree with the plug-in base 72 of the preceding embodiment example. The longitudinal slot 157 of this embodiment has a trapezoidal cross section. FIG. 5 includes a detailed view taken along the line A—A of FIG. 6, as mentioned above.

It is seen in FIG. 6 that the compressed-air canal 164 is provided with a turbulence generator in the form of an obstacle 176 which passes crosswise through the compressed-air canal. At this end, the compressed-air canal 164 becomes an air discharge nozzle 177 which has a free or available cross section that is not as large as the compressed-air canal 164.

In the third embodiment example according to FIGS. 7, 8 and 9, a splicing head 152 is shown which has a plug-in base 171 similar to the second embodiment example. The compressed-air canal 165 in this case becomes an air discharge nozzle 178 which has a smaller free or open cross section or cross-sectional area than the compressed-air canal 165. The air discharge nozzle 178 opens into the slot bottom of the longitudinal slot 158. The longitudinal slot 158 is symmetrically formed in the splicing head.

In the fourth embodiment example according to FIGS. 10, 11 and 12, a splicing head 153 with a plug-in base 172 is seen. The longitudinal slot 159 has a trapezoidal cross section. The free or available cross section of the compressed-air canal 166 is substantially larger than the slit-shaped cross section of the air discharge nozzle 179. In the compressed-air canal 166, a turbulence generator in the form of a screw thread 183 is seen. The lateral boundaries of the longitudinal slot 159 enclose an angle of 30°.

In the fifth embodiment example of the invention according to FIGS. 13, 14 and 15, a splicing head 154 with a plug-in base 173 is shown. In this embodiment the cross section of the longitudinal slot 160 forms a trapezoid, the longer base or parallel side of which lies in the bottom of the slot, so that in this case the lateral boundaries do not diverge but converge.

The slot bottom in this case has a substantially V-shaped groove 184 formed therein which extends along the longitudinal slot 180. The air discharge nozzle 180 lies directly on the flat slot bottom of the groove 184 and accordingly is in the form of a slit, as can be clearly seen from FIG. 14. Thus, the cross-sectional shape of the air discharge nozzle 180 also deviates in this embodiment from the circular cross section of the compressed-air canal 167. The lateral boundaries 185, 186 of the groove 184 are disposed at an angle of 30° to each other.

In this embodiment example, the ratio of the length of the longitudinal slot to the cross section of the longitudinal slot is 1.3 and the ratio of the slot cross section to the air discharge nozzle cross section is 3.7.

In the sixth embodiment example of the invention according to the drawings shown in FIGS. 16, 17 and 18, a splicing head 155 with a plug-in base 174 is seen. In this case as well, the longitudinal slot 161 has a cross section in the form of a trapezoid, the shorter base or parallel side of which forms the bottom of the slot. The compressed-air canal ends directly at the slot bottom, so that a slit-shaped air discharge nozzle 181 is obtained.

Thread-guiding and air-guiding means in the form of thread and air-guiding metal plates 187, 188 are disposed at the ends of the longitudinal slot 161. The air-guiding plates are fastened by spring pins 189 to end faces of the splicing head 155, and the covering effect that they produce is therefore adjustable. It is seen in the drawings that the thread and air-guiding metal plates partially cover the longitudinal slot 161, but only far enough so that the thread guidance is not impaired.

In the seventh and last embodiment example of the invention seen in FIGS. 19, 20 and 21, the splicing head 156 has a plug-in base 175. The longitudinal slot in this case also has a trapezoidal cross section and ends with its slot bottom at the compressed-air canal 169. In this embodiment as well, a slit-like air discharge nozzle 182 is again obtained.

Furthermore, in this embodiment example, thread guiding means in the form of thread guides 190 and 193 extending beyond the longitudinal slot 162 are provided. The thread guides cooperate in pairs.

The cover illustrated in the first embodiment example of the invention would not fit this splicing head 156. In this case, the corresponding cover does not extend beyond the splicing chamber in the direction of the longitudinal slot 162.

In all embodiment examples of the invention, the edges of the longitudinal slot should be rounded and smoothed. This is expressly pointed out because it is not directly visible in the drawings.

The invention is not limited to the embodiment examples described and shown. All features of the described and illustrated embodiment examples can be interchanged as desired and combined with each other.

Bulky threads, hairy or bristly threads, electrostatically charged threads and especially dry threads can be spliced well with devices according to the third and fifth embodiment examples. Fine threads, heavily twisted threads and sized threads or moist threads can be spliced better with devices according to the first and second embodiment examples. The devices according to the fifth, sixth and seventh embodiment examples can be used more universally for fine, thin threads as well as for bulky threads of cotton, wool or mixtures with synthetic fibers. In the sixth embodiment example, the adjustability of the thread and air-guiding metal plates 187, 188 are also advantageous.

There are claimed:

1. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body and said splicing head having a splicing chamber formed therein being in communication with said second compressed-air canal formed in said splicing head, said splicing chamber including a selectively coverable longitudinal slot for inserting and joining threads, said slot having a flat slot bottom and a substantially prismoidal cross section being modified in accordance with specifications of the threads to be spliced, and said splicing head having an air discharge nozzle formed therein at an end of said second compressed-air canal in vicinity of said splicing chamber, said air discharge nozzle having at least one of a smaller open cross section and a different cross-sectional shape than said second compressed-air canal.

2. Thread splicing device according to claim 1, including a cover for temporarily covering said longitudinal slot during splicing.

3. Thread splicing device according to claim 2, wherein said cover has ends and is extended beyond said splicing head along the direction of the length of said longitudinal slot, and including thread hold-down devices at said ends of said cover.

4. Thread splicing device according to claim 3, wherein said thread hold-down devices have air guiding surfaces formed thereon being directed at an angle against the travel direction of the threads to be spliced.

5. Thread splicing device according to claim 1, wherein said longitudinal slot has a substantially rectangular cross section.

6. Thread splicing device according to claim 5, wherein said splicing head has side walls of said longitudinal slot formed thereon, and the longer sides of said rectangular cross section of said longitudinal slot are disposed at said side walls.

7. Thread splicing device according to claim 1, wherein said longitudinal slot has a substantially trapezoidal cross section, the longer base of which is disposed at said slot bottom.

8. Thread splicing device according to claim 1, wherein said longitudinal slot has a substantially trapezoidal cross section, the shorter base of which is disposed at said slot bottom.

9. Thread splicing device according to claim 1, wherein said splicing head has a substantially V-shaped groove being formed therein in said slot bottom and extended along said longitudinal slot.

10. Thread splicing device according to claim 1, wherein said splicing head has a substantially U-shaped groove being formed therein in said slot bottom and extended along said longitudinal slot.

11. Thread splicing device according to claim 9 or 10, wherein compressed air from said second compressed-air canal discharges in said groove.

12. Thread splicing device according to claim 11, wherein said splicing head has lateral boundaries of said groove formed thereon being disposed at an angle of substantially 30° to each other.

13. Thread splicing device according to claim 9 or 10, wherein said splicing head has lateral boundaries of said groove formed thereon being disposed at an angle of substantially 30° to each other.

14. Thread splicing device according to claim 1, wherein said splicing head has rounded and smoothed edges of said longitudinal slot formed thereon.

15. Thread splicing device according to claim 1, wherein said splicing head has ends of said longitudinal slot formed thereon, and including means disposed at said ends for selectively guiding thread and air.

16. Thread splicing device according to claim 15, wherein said guiding means are in the form of metal plates partially closing off said ends of said slot.

17. Thread splicing device according to claim 15, wherein said guiding means are in the form of thread guides extended beyond said longitudinal slot.

18. Thread splicing device according to claim 1, wherein the ratio of the length of said longitudinal slot to the cross section of said longitudinal slot is between 0.5 and 1.0.

19. Thread splicing device according to claim 1, wherein the ratio of the length of said longitudinal slot to the cross section of said longitudinal slot is between 1.0 and 1.5.

20. Thread splicing device according to claim 1, wherein the ratio of the length of said longitudinal slot to the cross section of said longitudinal slot is between 2.5 and 4.0.

21. Thread splicing device according to claim 1, wherein at least one of said second compressed-air canal and said air discharge nozzle are disposed at the intersection of two planes of symmetry of said longitudinal slot.

22. Thread splicing device according to claim 1 or 21, wherein the ratio of the cross section of said longitudinal slot to the cross section of said air discharge nozzle is between 1.4 and 2.5.

23. Thread splicing device according to claim 1 or 21, wherein the ratio of the cross section of said longitudinal slot to the cross section of said air discharge nozzle is between 3.5 and 4.0.

24. Thread splicing device according to claim 1, wherein said air discharge nozzle is in the form of a slit being disposed in a plane of symmetry passing lengthwise through said longitudinal slot.

25. Thread splicing device, comprising a stationary base body having a first conpressed-air canal formed therein, a splicing head being interchangeably connected to said base body, said splicing head having a second compressed-air canal formed therein being in communication with said first compressed-air canal formed in said base body and said splicing head having a splicing chamber formed therein being in communication with said second compressed-air canal formed in said splicing head, said splicing chamber including a selectively coverable longitudinal slot for inserting and joining threads, said slot having a flat slot bottom and a substantially prismoidal cross section being modified in accordance with specifications of the threads to be spliced, and including a turbulence generator at least partly disposed in said second compressed-air canal.

26. Thread splicing device according to claim 25, wherein said turbulence generator is in the form of an obstacle extended crosswise through said second compressed-air canal.

27. Thread splicing device according to claim 26, wherein said splicing head has a wall of said second compressed-air canal formed thereon, and said turbulence generator is in the form of macroscopic wall irregularities on said wall.

28. Thread splicing device according to claim 27, wherein said wall irregularities are in the form of a screw thread disposed in said wall.

29. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body and said splicing head having a slicing chamber formed therein being in communication with said second compressed-air canal formed in said splicing head, said splicing chamber including a selectively coverable longitudinal slot for inserting and joining threads, said slot having a flat slot bottom and a substantially prismoidal cross section being modified in accordance with specifications of the threads to be spliced, and said splicing head including a plug-in base being extended into said base body, said second compressed-air canal being at least partly formed in said plug-in base.

30. Thread splicing device according to claim 29, wherein said plug-in base has a cylindrical outer surface having a flat formed thereon, and said base body includes a holding element directed toward said flat.

* * * * *